US008091632B2

(12) United States Patent
Diehl et al.

(10) Patent No.: US 8,091,632 B2
(45) Date of Patent: Jan. 10, 2012

(54) METHOD AND DEVICE FOR THE IN-SITU EXTRACTION OF A HYDROCARBON-CONTAINING SUBSTANCE FROM AN UNDERGROUND DEPOSIT

(75) Inventors: Dirk Diehl, Erlangen (DE); Norbert Huber, Erlangen (DE); Hans-Peter Krämer, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 232 days.

(21) Appl. No.: 12/526,743

(22) PCT Filed: Feb. 1, 2008

(86) PCT No.: PCT/EP2008/051282

§ 371 (c)(1), (2), (4) Date: Aug. 11, 2009

(87) PCT Pub. No.: WO2008/098850

PCT Pub. Date: Aug. 21, 2008

(65) Prior Publication Data

US 2010/0108318 A1 May 6, 2010

(30) Foreign Application Priority Data

Feb. 16, 2007 (DE) ..... 10 2007 008 292
Aug. 27, 2007 (DE) ..... 10 2007 040 606

(51) Int. Cl.
*E21B 36/00* (2006.01)
*E21B 36/04* (2006.01)
*E21B 43/24* (2006.01)

(52) U.S. Cl. ..... 166/248; 166/50; 166/52; 166/57; 166/272.3; 166/272.7; 166/302; 166/303

(58) Field of Classification Search ..... 166/248
See application file for complete search history.

(56) References Cited

U.S. PATENT DOCUMENTS 3,972,372 A * 8/1976 Fisher et al. ..... 166/248
(Continued)

FOREIGN PATENT DOCUMENTS

DE 4238247 A1 5/1993
(Continued)

OTHER PUBLICATIONS

European Search Report, application No. 08013369.7-1269, 5 pages, Oct. 2, 2008.

(Continued)

*Primary Examiner* — George Suchfield
(74) *Attorney, Agent, or Firm* — King & Spalding, L.L.P.

(57) ABSTRACT

A device for the in-situ extraction of a hydrocarbon-containing substance, while reducing the viscosity thereof, from an underground deposit, has at least one injection pipeline extending in the deposit and at least one production pipeline leading out of the deposit, which together form a so-called well pair. The injection and production pipelines each have a starting region extending above ground in some areas, and an active region connecting to the starting region inside the deposit. With the method, during a heating phase hot steam is applied to the injection and production pipelines, while during a production phase hot steam is applied only to the injection pipeline. Furthermore, the active region of the injection pipeline is additionally configured as an induction heater regarding the surrounding area in the deposit. In the associated device, for example, the well pair formed by the injection pipeline and production pipeline can be configured as electrodes.

19 Claims, 7 Drawing Sheets

U.S. PATENT DOCUMENTS

| | | | | |
|---|---|---|---|---|
| 4,008,761 | A * | 2/1977 | Fisher et al. | 166/248 |
| 4,043,393 | A * | 8/1977 | Fisher et al. | 166/248 |
| 4,238,247 | A | 12/1980 | Oster, Jr. | 136/246 |
| 4,456,065 | A | 6/1984 | Heim et al. | 166/248 |
| 4,545,435 | A | 10/1985 | Bridges et al. | 166/248 |
| 4,579,173 | A | 4/1986 | Rosensweig et al. | 166/248 |
| 4,787,449 | A | 11/1988 | Jones | 166/259 |
| 5,016,709 | A | 5/1991 | Combe et al. | 166/245 |
| 5,167,280 | A | 12/1992 | Sanchez et al. | 166/267 |
| 5,318,124 | A * | 6/1994 | Ong et al. | 166/272.3 |
| 6,285,014 | B1 | 9/2001 | Beck et al. | 219/644 |
| 6,840,226 | B2 | 1/2005 | Hans | |
| 6,921,035 | B2 | 7/2005 | Hohl | |
| 6,953,162 | B2 | 10/2005 | Hans | |
| 6,966,374 | B2 * | 11/2005 | Vinegar et al. | 166/272.3 |
| 7,559,367 | B2 * | 7/2009 | Vinegar et al. | 166/272.3 |
| 7,575,052 | B2 * | 8/2009 | Sandberg et al. | 166/248 |
| 7,793,722 | B2 * | 9/2010 | Vinegar et al. | 166/302 |
| 7,832,484 | B2 * | 11/2010 | Nguyen et al. | 166/302 |
| 2003/0168533 | A1 | 9/2003 | Hans | |
| 2003/0168534 | A1 | 9/2003 | Hohl | |
| 2003/0183201 | A1 | 10/2003 | Hans | |

FOREIGN PATENT DOCUMENTS

| | | | |
|---|---|---|---|
| DE | 10108195 | A1 | 8/2002 |
| EP | 1255036 | B1 | 9/2004 |
| RU | 2046934 | | 10/1995 |
| RU | 2151862 | | 6/2000 |
| RU | 2225942 | | 3/2004 |
| RU | 2237804 | | 10/2004 |
| RU | 2287679 | | 11/2006 |
| RU | 2304213 | | 8/2007 |
| RU | 2340768 | | 12/2008 |
| WO | 98/58156 | | 12/1998 |
| WO | WO02/073026 | A1 | 9/2002 |
| WO | WO02/073027 | A1 | 9/2002 |

OTHER PUBLICATIONS

Russian Office Action., Russian application No. 2009134488, 15 pages.

German Office Action, German application No. 10 2007 008 292.6-24, 3 pages.

Gates, I.D., et al., "Steam-Injection Strategy and Energetics of Steam-Assisted Gravity Drainage", SPE/PS-CIM/CHOA International Thermal Operations and Heavy Oil Symposium, Calgary, 2005; pp. 278-296.

Seim, J., "Oberseminarvortrag zum Komplex—Unkonventionelle Kohlenwasserstoffe", Thema Schweröle and Ultraschweröle, Freiberg (book); 12 pages.

* cited by examiner

METHOD AND DEVICE FOR THE IN-SITU EXTRACTION OF A HYDROCARBON-CONTAINING SUBSTANCE FROM AN UNDERGROUND DEPOSIT

CROSS-REFERENCE TO RELATED APPLICATIONS

This application is a U.S. National Stage Application of International Application No. PCT/EP2008/051282 filed Feb. 1, 2008, which designates the United States of America, and claims priority to German Application No. 10 2007 008 292.6 filed Feb. 16, 2007 and German Application No. 10 2007 040 606.3 filed Aug. 27, 2007, the contents of which are hereby incorporated by reference in their entirety.

TECHNICAL FIELD

The invention refers to a method for the in-situ extraction of a hydrocarbonaceous substance, while reducing its viscosity, from an underground deposit.

In addition to this, the invention relates to an associated installation with at least one device which has at least one injection pipeline which projects into the deposit and at least one production pipeline which leads out of the deposit.

BACKGROUND

The injection pipeline and the production pipeline in this case have in each case a starting section, which extends partially above-ground, and an active section which is connected to the starting section and extends inside the deposit. During a heating-up phase, the injection pipeline and the production pipeline can be exposed to admission of superheated steam. During a production phase, the injection pipeline can be exposed to admission of superheated steam. Such a device for the extraction of hydrocarbonaceous substances from an underground deposit results for example from "Steam-Injection Strategy and Energetics of Steam-Assisted Gravity Drainage" by I. D. Gates, 2005, SPE International Thermal Operations and Heavy Oil Symposium, Calgary, Canada, 1.-3. November 2005.

According to current estimates, large parts of the worldwide oil reserves exist in the form of so-called oil sands. Oil sand is typically a mixture of clay, sand, water and bitumen. The bitumen can be converted by further process steps into synthetic crude oil. Oil sand deposits are currently preferably extracted in open-cut mining. Oil sand deposits which are located in deeper layers of the earth, however, are extracted with in-situ methods, such as with the SAGD (Steam Assisted Gravity Drainage) method.

In the case of the SAGD method, the bitumen which is present in a deposit is heated by means of superheated steam. In this way, its viscosity is reduced. The bitumen which is liquefied in such a way is extracted from the deposit and supplied to further process steps. Synthetic crude oil can be produced from the bitumen which is extracted from the underground deposit.

For the extraction of oil sand deposits with an in-situ method, pipelines are typically first of all laid inside the deposit. Two pipes which are arranged essentially parallel to each other and extend horizontally are frequently arranged inside the deposit. Such pipes typically have a distance of 5 to 10 m from each other in the vertical direction and have a length of between 500 and 1000 m. At the start of the extraction, the deposit first has to be heated in order to reduce the viscosity of the bitumen which is present in the oil sand, and it is then able to be extracted in liquefied form. For heating the deposit, the two pipes which extend inside the deposit are typically exposed to admission of superheated steam. After the termination of the approximately 3-month heating-up phase, in the subsequent production phase only the pipe which lies geodetically higher is exposed to admission of superheated steam. The superheated steam which is injected into this pipe leads on the one hand to further liquefaction of the bitumen which is present in the deposit, and on the other hand leads to a positive pressure in the deposit. Driven by this positive pressure, liquefied bitumen can be transported in the meantime through the second pipeline to the earth's surface.

The currently applied SAGD method has diverse technical problems. On the one hand, superheated steam can escape from the actual area of the deposit via passages which exist in the area of the deposit or which are attributable to further geological features inside the deposit, for example porous rock layers. The superheated steam which escapes in this way is lost for extraction of the bitumen.

Furthermore, the quantity of heat, which can be introduced into the deposit by means of superheated steam, is limited for the following reasons. The quantity of heat which can be introduced into the deposit is determined to a substantial degree by the maximum permissible pressure with which superheated steam can be injected into the deposit. Oil sand deposits are typically not located at very great depths so that as a result of an excessive pressure build-up inside the deposit earth displacements on the surface can occur. Furthermore, large amounts of water are required for the extraction of bitumen from oil sand deposits by means of the SAGD method. The required amount of water is measured based on the so-called "steam to oil ratio" (SOR). Strict environmental requirements in the extraction fields require an SOR which is as low as possible in order to take into consideration the conserving of ground water supplies.

The extraction duration of an oil sand deposit, which is extracted using two pipes with the typical previously mentioned dimensions, is typically within the range of between 3 and 10 years. Over this time, the deposit is continuously heated with superheated steam. On account of the thermal conductivity of the soil, the heat which is introduced into the deposit reaches in the course of time ever greater distances from the point at which superheated steam is introduced into the deposit. The intake area of the production pipe, via which liquefied bitumen is transported to the surface, is spatially limited. Heat, which reaches beyond the limits for the intake area of the production pipe, is lost for the production of bitumen. This phenomenon leads not only to a deterioration of the "steam to oil ratio" but also to a poor overall energy balance of the deposit in question.

SUMMARY

According to various embodiments, a method for the extraction of hydrocarbonaceous substances from an underground deposit can be provided, which is improved with regard to the solutions which are known in the prior art. In particular, by means of an associated installation the overall energy balance for the extraction of the hydrocarbonaceous substance and also the "steam to oil ratio" which is encountered during the extraction of this substance are to be improved.

According to an embodiment, in a method for the in-situ extraction of a hydrocarbonaceous substance, while reducing its viscosity, from an underground deposit with a device which has at least one injection pipeline which projects into the deposit and at least one production pipeline which leads from the deposit, wherein the injection pipeline and the production pipeline have in each case a starting section which extends partially above ground and an active section which is connected to the starting section and extends inside the deposit, and at least the active section of the injection pipeline is additionally formed as an induction heater with respect to its surroundings in the deposit, a heating-up phase and a production phase, which with respect to time follows the heating-up phase, are provided, wherein during the heating-up phase the injection pipeline and the production pipeline are exposed to admission of superheated steam and during the production phase only the injection pipeline is exposed to admission of superheated steam and the surroundings of the active section of the injection pipeline are additionally heated by means of the induction heater.

According to a further embodiment, at least the active sections of the injection pipeline and of the production pipeline may be part of a resistance heater, and during the heating-up phase the surroundings of the active sections of the injection pipeline and of the production pipeline may be heated with the resistance heater.

According to another embodiment, a device for in-situ extraction of a hydrocarbonaceous substance, while reducing its viscosity, from an underground deposit comprises at least one injection pipeline which projects into the deposit and at least one production pipeline which leads from the deposit, wherein the injection pipeline and the production pipeline have in each case a starting section which extends partially above ground and an active section which is connected to the starting section and extends inside the deposit, and during a heating-up phase the injection pipeline and the production pipeline can be exposed to admission of superheated steam, and during a production phase only the injection pipeline can be exposed to admission of superheated steam, and wherein at least the active section of the injection pipeline is additionally formed as an induction heater with respect to its surroundings in the deposit.

According to a further embodiment, the injection pipeline additionally may have an end section which is connected to the active section and extends partially above ground, and a power source is electrically connected to the part of the starting section and end section of the injection pipeline which extends above ground. According to a further embodiment, the injection pipeline may have an end section which is connected to the active section and extends inside the deposit, and the end section of the injection pipeline, with an electrical conductor which by means of an auxiliary bore is introduced into the vicinity of the end section of the injection pipeline, is electrically connected to a reservoir containing a saline liquid. According to a further embodiment, the active section of the injection pipeline may describe an almost closed circle inside the deposit in the horizontal direction, and an end section which is located partially above ground is connected to the active section, wherein the parts of the starting section and of the end section of the injection pipeline which are located above ground are electrically connected to a power source. According to a further embodiment, the device may further comprise a multiplicity of injection pipelines which have in each case end sections which are connected to the active sections and extend partially above ground, wherein at least the part of an end section of a first injection pipeline which is located above ground is electrically connected to the part of the starting section of a second injection pipeline which is located above ground. According to a further embodiment, during the production phase the injection pipeline can be exposed to admission of special superheated steam, the liquid phase of which has an increased electrical conductivity compared to water. According to a further embodiment, the liquid phase can be a saline liquid. According to a further embodiment, the induction heater may operate with a frequency of 10 kHz to 100 kHz. According to a further embodiment, at least the active sections of the injection pipeline and of the production pipeline can be part of a resistance heater with respect to a part of the deposit which lies essentially between the injection pipeline and the production pipeline. According to a further embodiment, the injection pipeline and the production pipeline can be at least partially electrically insulated with respect to their surroundings. According to a further embodiment, the injection pipeline and the production pipeline can be electrically insulated with respect to their surroundings at least in the areas which extend outside the deposit. According to a further embodiment, the resistance heater may be operated with alternating current, preferably with alternating current of a frequency of 50 to 60 Hz.

According to a further embodiment, the elementary unit of the deposit may have a cross section of w×h, wherein the vertical distance of the injection pipeline from the extraction pipe is between 0.2 h and 0.9 h, and wherein there are additional electrodes. According to a further embodiment, the lateral distance of the injection pipe from the additional electrodes can be between 0.1 W and 0.8 W. According to a further embodiment, there can be at least two horizontally guided electrodes. According to a further embodiment, the extraction pipe and the injection pipe may form a pair (so-called "well pair"), wherein the upper pipe is also formed as an electrode and with the remote horizontal pipe forms a unit for energizing with current.

BRIEF DESCRIPTION OF THE DRAWINGS

In the drawing, preferred developments of the device according to various embodiments are indicated in a schematized representation. In the drawing in this case

Figure 1:
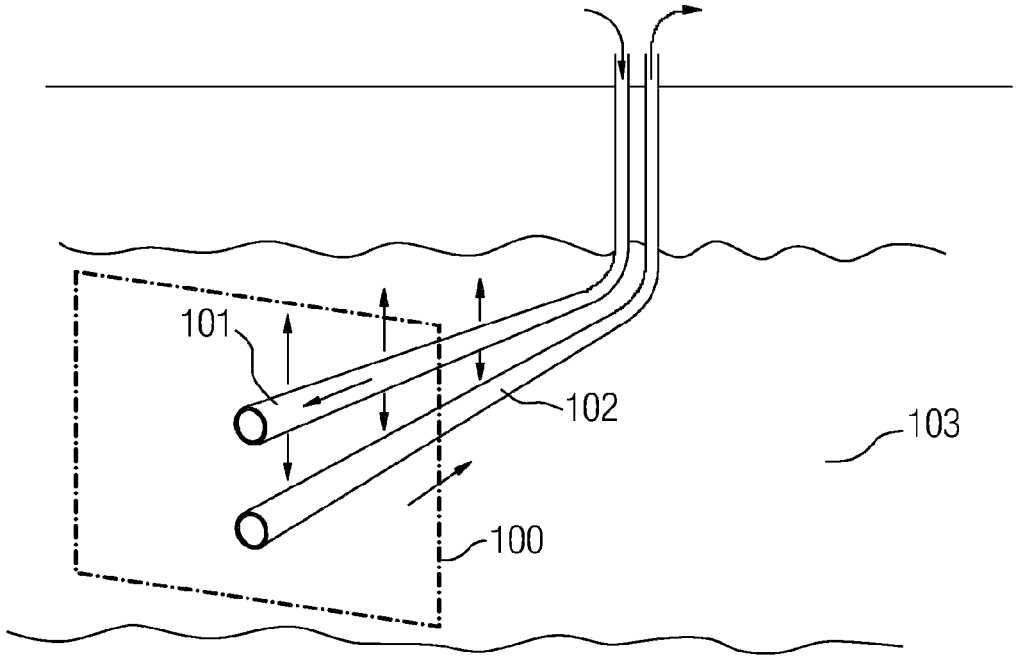
FIG. 1 shows an installation for the extraction of a hydrocarbonaceous substance from an underground deposit with a device which is formed from at least one well pair.

Parts which correspond to each other in the figures are provided with the same designations in each case. Parts which are not explained in more detail are generally known prior art.

DETAILED DESCRIPTION

According to various embodiments, the injection pipeline is equipped with an induction heater in order to introduce additional heat into the deposit.

A pipeline which extends at least partially inside a deposit and which serves primarily for heating the deposit by means of superheated steam or other measures is to be understood by an injection pipeline in this connection. A pipeline which extends at least partially inside the deposit and which serves both for heating the deposit and for transporting hydrocarbonaceous substances from the deposit to the earth's surface, is to be understood by a production pipeline.

According to various embodiments, an installation or device for the in-situ extraction of a hydrocarbonaceous substance, while reducing its viscosity, from an underground deposit, with at least one injection pipeline which projects into the deposit and at least one production pipeline which leads out of the deposit, is disclosed. The injection pipeline and the production pipeline have in each case a starting section which extends at least partially above ground, and an active section which is connected to the starting section and extends inside the deposit. During a heating-up phase, the injection pipeline and the production pipeline can be exposed to admission of superheated steam. During a production phase, only the injection pipeline can be exposed to admission of superheated steam. Furthermore, the active section of the injection pipeline is additionally to be formed as an induction heater with respect to its surroundings in the deposit.

An installation with a device according to various embodiments for the in-situ extraction of a hydrocarbonaceous substance allows the deposit to be heated not only with superheated steam but also inductively heated in addition by means of the injection pipeline which is formed as an induction heater. In this way, a quicker heating of the deposit can be achieved. A quicker heating of the deposit leads to a higher production of hydrocarbonaceous substance from the deposit and at the same time improves the "steam to oil ratio" since in addition to superheated steam electrical energy is also used for heating the deposit. A quicker heating of the deposit furthermore leads to a reduction of heat losses as a result of thermal conduction inside the deposit. The portion of thermal energy, which reaches the areas outside the intake region of the production pipeline, can be reduced in this way. The superheated steam which is introduced into the injection pipeline leads to heating of the deposit essentially in a volume which is located geodetically above the injection pipeline. As seen in cross section, this volume represents the shape of a dumbbell or a pestle. As seen in cross section, the volume which is heated by the superheated steam increases, starting from the injection pipeline. In the upper area, the volume is terminated by means of a slightly upwards curved surface. The heat loss distribution of an induction heater makes a significant contribution in the previously described area which is also heated by superheated steam and is geodetically above the injection pipeline in the deposit.

According to various embodiments, both the superheated steam which is introduced into the injection pipeline and the induction heater lead therefore to heating of the deposit in very similar areas. In this way, the deposit can be heated particularly quickly in this overlapping area. This particularly quick heating leads to an energetically effective production, a high production volume and a low SOR. In addition to the injection pipeline which is also used as an inductor electrode, there may be further inductors for heating the boundary areas.

Further embodiments of the installation or device for the in-situ extraction of a hydrocarbonaceous substance are discussed below. According to various further embodiments, a device for the extraction of hydrocarbonaceous substances can additionally have the following features:

The injection pipeline can additionally have an end section which is connected to the active section and extends partially above ground. The parts of the starting section and end section of the injection pipeline which extend above ground can be electrically connected to a power source. If the starting section and end section of an injection pipeline lie above ground, then these can be electrically connected in a particularly simple manner.

The injection pipeline can have an end section which is connected to the active section and extends inside the deposit. The end section of the injection pipeline, with the aid of a reservoir containing a saline liquid, can be electrically connected to an electrical conductor which is introduced by means of an auxiliary bore into the vicinity of the end section of the injection pipeline. By a reservoir containing a saline liquid being in contact with the end section of the injection pipeline, and also by an electrical conductor being introduced which is located in the vicinity of this end section, an especially simple electrical connecting of the end section of the injection pipeline can be determined.

The active section of the injection pipeline can describe an almost closed circle inside the deposit in the horizontal direction. An end section which is located partially above ground can be connected to the active section. The parts of the starting section and end section of the injection pipeline which are located above ground can be electrically connected to a power source. By means of an injection pipeline which extends along an almost closed circle inside the deposit, a large area of the deposit can advantageously be inductively heated. At the same time, with an injection pipeline which is designed in such a way, the starting and end sections of the injection pipeline lie above ground so that these are simple to connect.

An installation according to an embodiment for the in-situ extraction of a hydrocarbonaceous substance, while reducing its viscosity, from an underground deposit can have individual devices with a multiplicity of injection pipelines. The injection pipelines have in each case an end section which is connected to the active section and extends partially above ground. Furthermore, a part of an end section of a first injection pipeline which is located above ground can be electrically connected to the part of the starting section of a second injection pipeline which is located above ground. According to the previously described embodiment, a device can be disclosed with which a large area of a deposit can be heated by a single system. For example, a single power supply can be sufficient in order to inductively heat a multiplicity of injection pipelines and therefore a large area of a deposit.

During the production phase, the injection pipeline can be exposable to admission of special superheated steam, the liquid phase of which has an increased electrical conductivity compared to water. By special superheated steam being injected into the deposit via the injection pipeline the electrical conductivity of the deposit can be increased. This increase of conductivity leads to greater eddy-current losses in the parts in question of the deposit. In this way, the parts in question of the deposit can be heated more intensely which leads to an increase of production capacity. Superheated steam of a saline liquid can preferably be used for this purpose. An installation according to the foregoing embodiment furthermore has a self-regulating mechanism. Those areas of the deposit which as a result of injecting the special superheated steam are increased in their electrical conductivity are inductively intensely heated. If the special superheated steam in the areas in question of the deposit has been heated to the extent that it has advanced into more remote areas of the deposit, then the electrical conductivity of the area in question of the deposit is reduced again. As a result, these areas are reheated less intensely.

The induction heater can be operated at a frequency of 5 kHz to 100 kHz, preferably at a frequency of 10 kHz to 100 kHz. For operation of an induction heater at a frequency of 5 kHz or 10 kHz to 100 kHz, commercially available converters can be used. By using standard components a cost advantage results for a device which is designed in such a way.

The active sections of the injection pipeline and of the production pipeline can be part of a resistance heater with respect to a part of the deposit which lies essentially between the injection pipeline and the production pipeline. According to the previously described embodiment, the heat loss of the resistance heater makes a significant contribution in an area between the injection pipeline and the production pipeline. From this area, a substance as a first hydrocarbonaceous substance is extracted from the deposit at the beginning of the extraction. By just that area being additionally heated by means of a resistance heater the production of hydrocarbonaceous substance from the deposit can be carried out quicker. The deposit can be exploited more effectively in this way.

The injection pipeline and the production pipeline can be at least partially electrically insulated with respect to their surroundings, the injection pipeline and the production pipeline can preferably be electrically insulated with respect to their surroundings at least in the areas which extend outside the deposit. By means of a purposeful electrical insulation of specific areas of the injection pipeline and of the production pipeline, those areas in which the injection pipeline and the production pipeline are not electrically insulated with respect to the soil which surrounds them, can be heated up. In this way, for example the deposit or specific parts of the deposit can be purposefully heated without unnecessary heating occurring in further areas of the soil.

The resistance heater can be operated with alternating current, preferably with alternating current of a frequency of 50 to 60 Hz. For operation of the resistance heater at a frequency of 50 to 60 Hz, commercially available components can be used for realizing the resistance heater. In this way, a cost advantage results.

Within the scope of the invention, the method can be based on the consideration of heating a first part of the deposit, which is located essentially between the injection pipeline and the production pipeline, both by means of superheated steam and by means of an electric heater which in addition to inductively can possibly also function resistively, during a heating-up phase which with respect to time precedes the production phase. During the subsequent production phase a further part of the deposit, which is preferably located geodetically above the injection pipeline, is then to be advantageously further heated essentially by means of superheated steam on the one hand and by means of electromagnetic induction on the other hand.

For the in-situ extraction of a hydrocarbonaceous substance, while reducing its viscosity, from an underground deposit, a device which is to be described in the following and which is part of an overall installation with reoccurring units, is to be used. A device which is suitable for the method according to various embodiments has at least one injection pipeline which projects into the deposit and at least one production pipeline which leads out of the deposit. The injection pipeline and the production pipeline have in each case a starting section which extends partially above ground and an active section which is connected to the starting section and extends inside the deposit. The active section of the injection pipeline is to be additionally formed as an induction heater with respect to its surroundings in the deposit. According to various embodiments, the method for the in-situ extraction of a hydrocarbonaceous substance, while reducing its viscosity, has a heating-up phase and a production phase which with respect to time follows the heating-up phase. During the heating-up phase, the injection pipeline and the production pipeline are to be exposed to admission of superheated steam. During the production phase, only the injection pipeline is to be exposed to admission of superheated steam, and the surroundings of the active section of the injection pipeline are additionally to be heated by means of the induction heater.

The time span during which the deposit is heated, for reducing the viscosity of the hydrocarbonaceous substance which is to be extracted from the deposit, is essentially to be understood by a heating-up phase in this connection. That time span during which hydrocarbonaceous substance which is already reduced in its viscosity is extracted from the underground deposit by means of the production pipeline is essentially to be understood by a production phase.

The method according to various embodiments has the following advantages: since according to various embodiments the deposit during the production phase is not only further heated by means of superheated steam but the surroundings of the injection pipeline are additionally heated by means of the induction heater, additional thermal energy can be introduced into the deposit. This thermal energy which is additionally introduced into the deposit by electrical means leads to a reduction of the SOR ("Steam to Oil Ratio"), furthermore increases production, and leads to lower heat losses on account of thermal conduction inside the deposit.

The method according to various embodiments can furthermore additionally have the following advantages:

The active section of the injection pipeline and of the production pipeline can be part of a resistance heater. Furthermore, during the heating-up phase the surrounds of the active sections of the injection pipeline and of the production pipeline can be heated with the resistance heater. In this way, a first part of the deposit can advantageously be heated not only by means of superheated steam but additionally by means of a resistance heater. The area of the deposit which is additionally heated in this way is located essentially between the injection pipeline and the production pipeline. By means of the resistance heater additional thermal energy can be introduced in this area. In this way, the area in question can be heated particularly quickly. This quick heating leads to a rapid liquefaction of hydrocarbonaceous substance which is present in the deposit so that this can be rapidly extracted. In the production phase, that is to say when hydrocarbonaceous substance is already being extracted from the underground deposit, a second part of the deposit, which is located essentially geodetically above the injection pipeline, is heated not only by means of superheated steam but additionally by means of an induction heater. This additional heating of the deposit leads to an increase of the production volume, lowers the "steam to oil ratio", and, since the production time can be curtailed, leads to lower heat losses as a result of thermal conduction of the soil.

Schematically represented, FIG. 1 shows an installation 100 for the in-situ extraction of a hydrocarbonaceous substance, while reducing its viscosity, from an underground deposit. In the case of such a device, it can be for example a device for the extraction of bitumen from an oil sand deposit. Such devices are known for example from "Steam-Injection Strategy and Energetics of Steam-Assisted Gravity Drainage" by I. D. Gates, 2005, SPE International Thermal Operations and Heavy Oil Symposium, Calgary, Canada, 1.-3. November 2005. Such a device 100 has an injection pipeline 101 and a production pipeline 102. Devices 100 for the extraction of bitumen from an underground deposit 103 which have a plurality of injection pipelines 101, which are customarily also referred to as an "injection well", and also a plurality of production pipelines 102, which are customarily also referred to as a "production well", are also conceivable. In the following text, for reasons of clarity, the extraction of bitumen from an oil sand deposit 103 is to be frequently spoken of, but the embodiments also refer in general to an extraction of a hydrocarbonaceous substance from an underground deposit. So, in the case of the deposit 103, in addition to an oil sand deposit, it can also be an oil shale deposit or other deposit which is located underground, from which oils, heavy oils or hydrocarbonaceous substances in general can be extracted.

In order to be able to extract bitumen from a deposit 103 this is typically heated by means of superheated steam which is injected into the injection pipeline 101. The thermal energy which is introduced into the deposit 103 in this way leads to a reduction of the viscosity of the bitumen which is released in the deposit 103. In this way, liquefied bitumen is transported to the earth's surface by means of the production pipeline 102 on account of the positive pressure which prevails inside the deposit 103. On the earth's surface, the bitumen is supplied to further treatment steps so that so-called synthetic crude oil can be produced.

Figure 2:
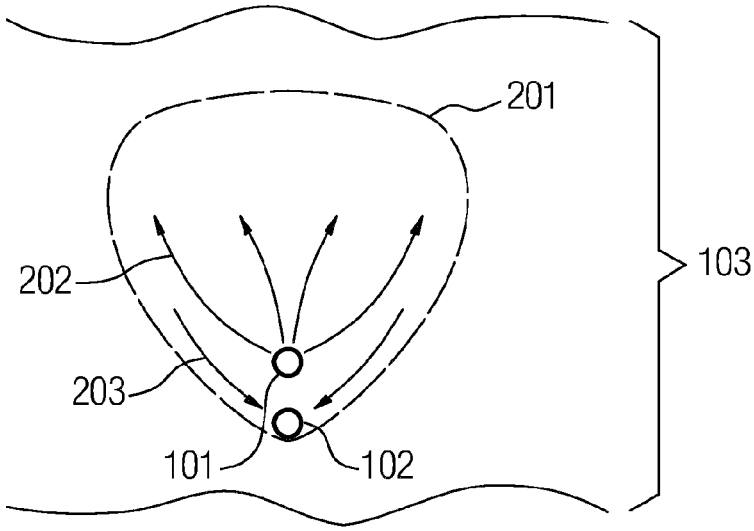
FIG. 2 shows a cross section through the extraction area of a deposit.

FIG. 2 shows a cross section through a deposit, for example an oil sand deposit 103, and also through the injection pipeline 101 and production pipeline 102 which extend inside the deposit 103. The superheated steam which is injected into the injection pipeline 101 leads to the heating of a part 201 of the deposit 103. The cross section of the deposit 103 widens in the upward direction and has a flat or slightly curved end. Inside this heated area 201, superheated steam rises in the deposit 103, which is indicated with arrows 202. The thermal energy which in this way is introduced into the deposit 103 or into the area 201 which is to be heated leads to a liquefaction of the bitumen which is present in the deposit. Induced by gravity, liquefied bitumen flows in the direction of the production pipeline 102. The direction of flow of the liquefied bitumen is to be indicated with arrows 203.

Figure 3:
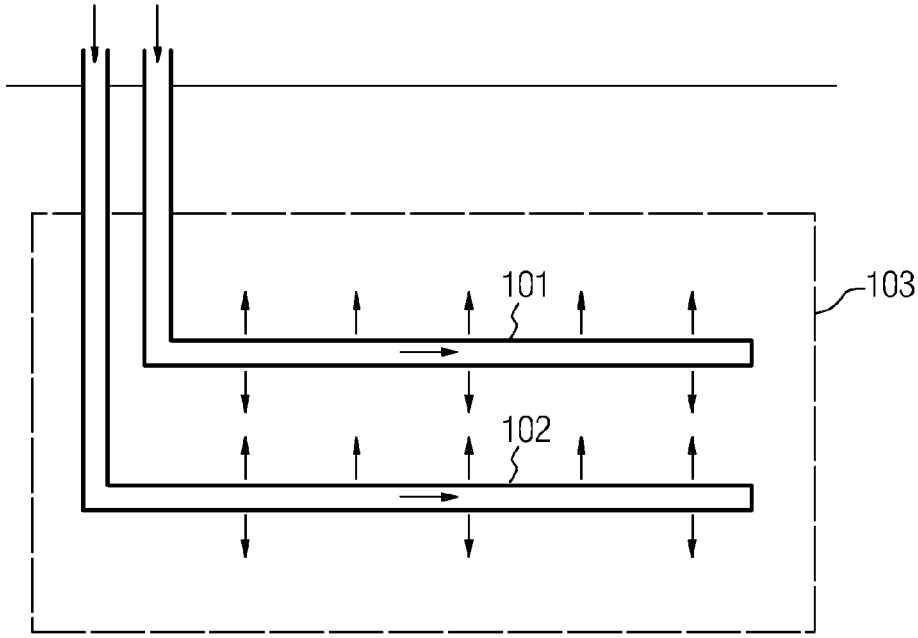
FIGS. 3, 4 show the installation for the extraction of a hydrocarbonaceous substance from an underground deposit during the heating-up phase or during the production phase respectively.

FIG. 3 shows the part of a device 100 for the extraction of bitumen from a deposit, for example from an oil sand deposit 103, during a heating-up phase. During the heating-up phase, both the injection pipeline 101 and the production pipeline 102 are exposed to admission of superheated steam. In this way, the deposit 103 is heated so that the viscosity of the bitumen which is present in the deposit 103 is reduced.

Figure 4:
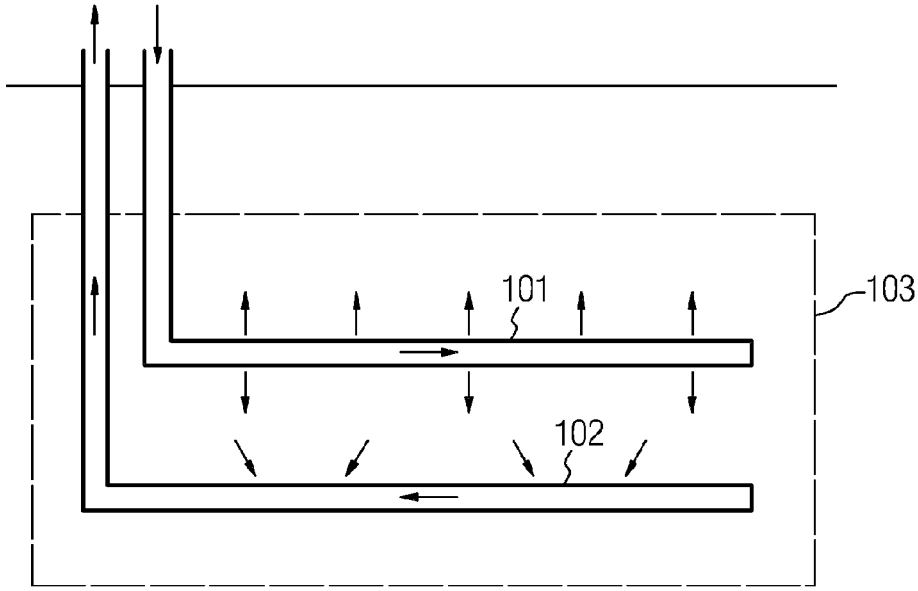

FIG. 4 shows a device for the extraction of bitumen from a deposit 103 during a production phase. During the production phase, only the injection pipeline 101 is exposed to the admission of superheated steam. The deposit 103 is further heated in this way. At the same time, a positive pressure is built up in the soil, especially in the deposit 103. As a result of the positive pressure which is present in the deposit 103 liquefied bitumen is transported via the production pipeline 102 to the earth's surface. The bitumen which is transported to the earth's surface can be supplied to further process steps.

Figure 5:
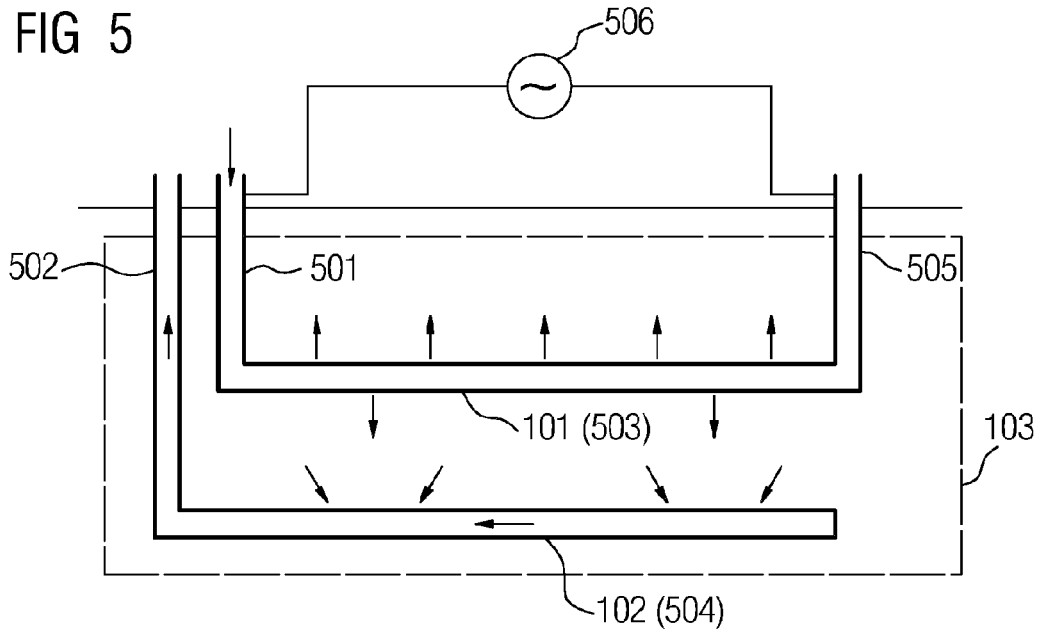
FIGS. 5, 6 show the installation for the extraction of a hydrocarbonaceous substance from an underground deposit, wherein the injection pipeline is formed as an induction heater.

FIG. 5 shows a device 100 for the extraction of a hydrocarbonaceous substance, for example bitumen, from a deposit 103, for example from an oil sand deposit, according to one exemplary embodiment. In the following text, the principle of operation of the device 100 during the production phase is to be described.

The device 100 has an injection pipeline 101 which projects into the deposit 103 and a production pipeline 102 which leads from the deposit 103. Both the injection pipeline 101 and the production pipeline 102 have a starting section 501, 502 which extends partially above ground. The active section 503 of the injection pipeline 101 or the active section 504 of the production pipeline 102 is connected in each case to the starting section 501, 502. The injection pipeline 101 can furthermore have an end section 505 which is connected to its active section 503 and which also extends partially above ground. The starting section 501 and also the end section 505 of the injection pipeline 101 are connected to a power source 506 by their sections which extend above ground. In the case of the power source 506 it can preferably be an alternating current source with a frequency of between 10 kHz and 100 kHz. The induction heater can be formed by parts of the injection pipeline. Only the active section 503 of the injection pipeline 101 is preferably formed as an induction heater. As the electrically conducting part of the induction heater, the material of the injection pipeline 101 or the material of the active section 503 of the injection pipeline 101 itself can be used. The induction heater can furthermore be designed in such a way that the starting section and end section 501, 505 of the injection pipeline 101 is thermally insulated with respect to the surrounding earth area or with respect to the deposit 103 so that in a purposeful manner thermal energy can be inductively introduced into the deposit 103 only in a non-thermally insulated area, such as in the active section 503 of the injection pipeline 101. The injection pipeline 101 can furthermore be exposed to admission of superheated steam. In this way, the positive pressure which is required for the extraction of bitumen can be created inside the deposit 103.

Figure 6:
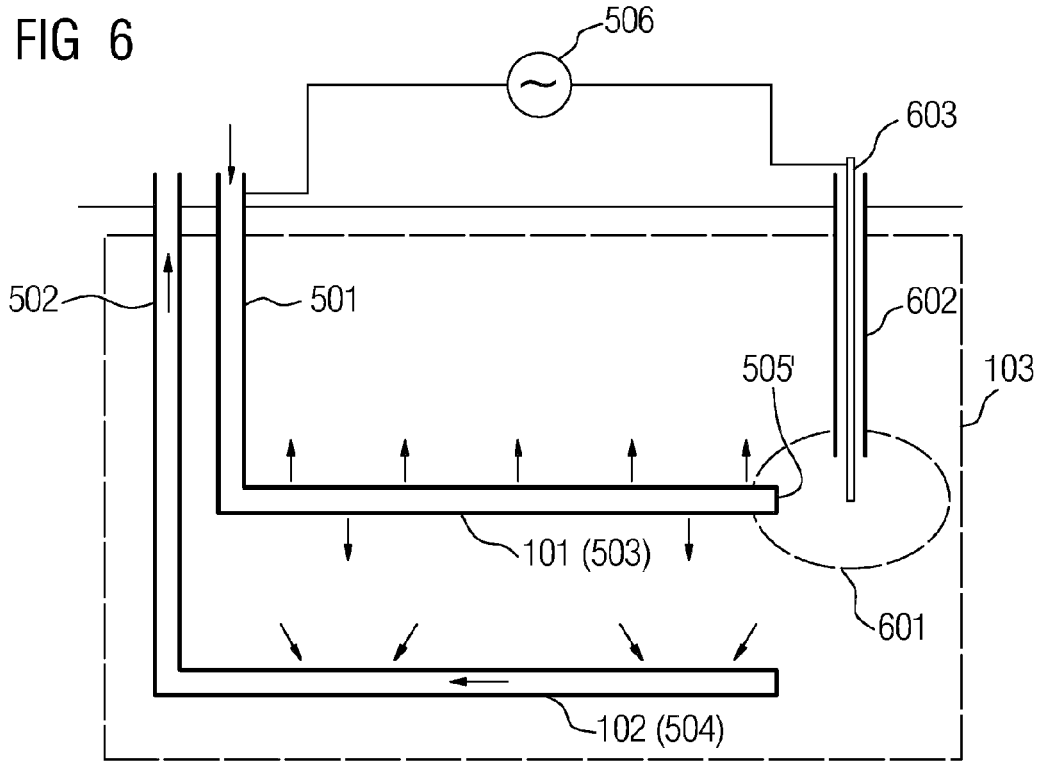

FIG. 6 shows a further device for the extraction of bitumen from an oil sand deposit 103 according to a further exemplary embodiment. According to this exemplary embodiment, the injection pipeline 101 by its end section 505', which in this case is located inside the deposit 103, is electrically connected to a reservoir 601 containing a saline liquid. The reservoir 601 containing a saline liquid or another easily conductive liquid can be introduced via an auxiliary bore 602 into the vicinity of the end section 505' of the injection pipeline 101. By means of the auxiliary bore 602, an electrical conductor 603 can furthermore be inserted into the reservoir 601. This conductor 603 and also the starting section 501 of the injection pipeline 101 are electrically connected to a power source 506. The connecting of the end section 505' of the injection pipeline 101 can furthermore be created for example by means of a gripper or by other suitable measures. Such a gripper can be attached on the end of the conductor 603.

Figure 7:
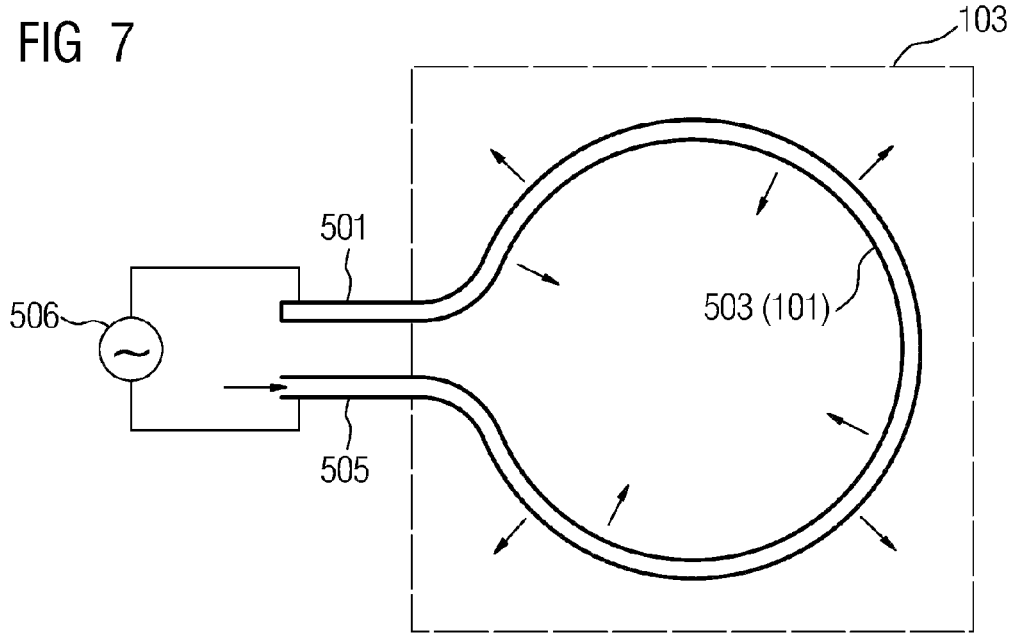
FIGS. 7, 8 show the installation for the extraction of a hydrocarbonaceous substance from an underground deposit, wherein the deposit can be heated over a large area.

FIG. 7 shows in plan view a device 100 for the extraction of bitumen from an oil sand deposit 103. According to this exemplary embodiment, the active section 503 of the injection pipeline 101 describes an almost complete circle. The active section 503 of the injection pipeline 101 extends in a plane inside the deposit 103, preferably in an approximately circular, horizontally lying arc, if the deposit 103 extends further in the horizontal direction than in the vertical direction. The starting section 501 and also the end section 505 of the injection pipeline 101 can lie at least partially above the earth's surface. The parts of the starting section 501 and of the end section 505 which lie above the earth's surface can be connected to an electrical power source 506. By means of an active section 503, which is designed in an almost circular manner, of the injection pipeline 101 a large area of the deposit 103 can be heated inductively or by means of superheated steam. The production pipeline, which is not shown in FIG. 7, in a like manner can extend several meters beneath the injection pipeline 101, that is to say geodetically deeper than the injection pipeline 101, also in an almost circular shape inside the deposit 103.

Figure 8:
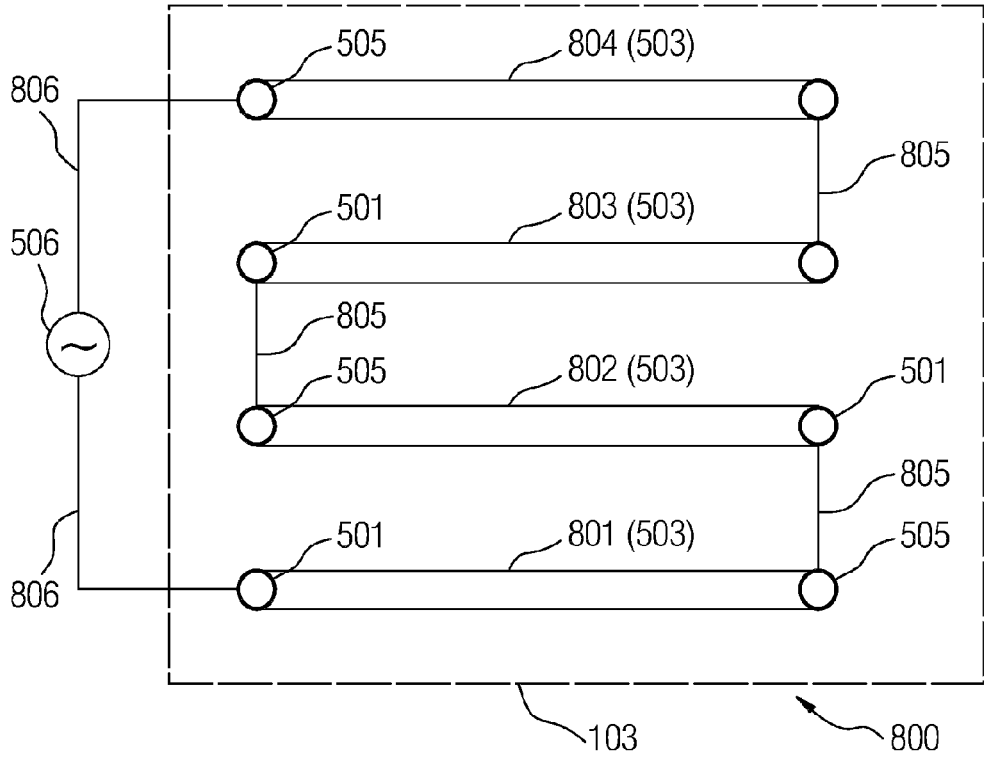

FIG. 8 shows in plan view a device 800 which has a multiplicity of injection pipelines 801 to 804. According to this exemplary embodiment, an end section 505 of a first injection pipeline 801 is connected in each case to a starting section 501 of a second injection pipeline 802. This electrical connection 805 can preferably be carried out on the parts of the starting sections 501 or end sections 505 of the injection pipelines 801 which are located above ground. The end section 505 of the second injection pipeline 802 can in turn be connected via an electrical connection 805 to the starting section 501 of a third injection pipeline 803. In the previously described manner, any number of injection pipelines can be electrically interconnected so that a deposit 103 can be inductively heated over a large area. The starting section 501 of a first injection pipeline 801 and also the end section 505 of a further, for example the fourth, injection pipeline 804 can in turn be electrically connected to a power source 506. According to the exemplary embodiment which is shown in FIG. 8, the feed lines 806 between the power source 506 and the starting sections 501 or end sections 505 of the injection pipelines 801, 804 which are to be connected in each case can be kept as short as possible.

Figure 9:
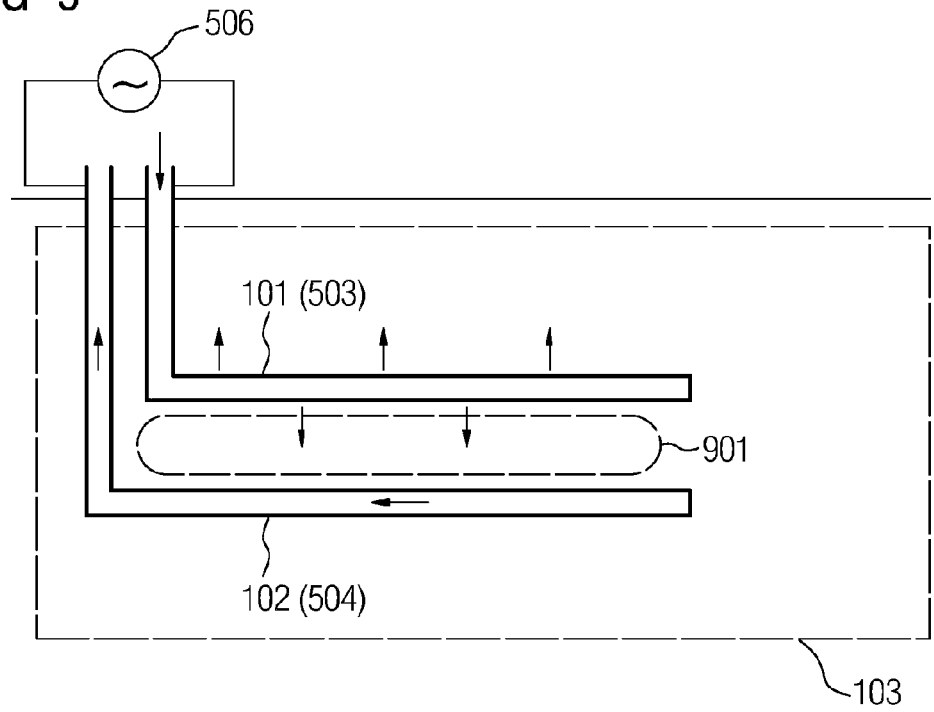
FIGS. 9, 10 show the installation for the extraction of a hydrocarbonaceous substance from an underground deposit, wherein the injection pipeline and production pipeline are part of a resistance heater.
Figure 10:
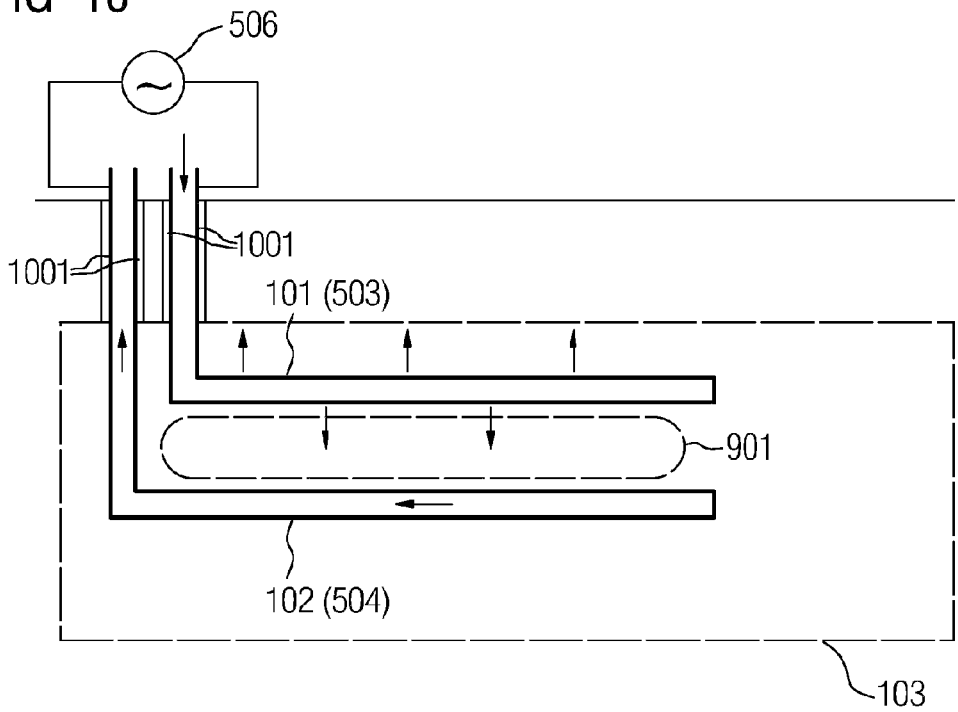

FIGS. 9 and 10 show further devices 100 for the extraction of bitumen from an oil sand deposit 103 according to further exemplary embodiments. At least the active section 503 of the injection pipeline 101 and also the active section 504 of the production pipeline 102 can be formed as a resistance heater. The injection pipeline 101 and also the production pipeline 102 can be electrically connected to a power source 506. The electrically conductive part of the resistance heater can be formed by means of the material of the injection pipeline 101 or of the production pipeline 102, but at least by means of the material of the respectively active parts 503 or 504 of the pipelines 101, 102 itself.

The electric current which is applied to the injection pipeline 101 and also to the production pipeline 102 flows via an area 901 of the deposit 103 which is located essentially between the injection pipeline 101 and the production pipeline 102. As a result, a large part of the heat loss of the resistance heater occurs in this area 901 of the deposit 103. As a result, this area 901 of the deposit 103 is heated particularly intensely.

The injection pipeline 101 and/or the production pipeline 102 can at least partially have an electrical insulation 1001. The electrical insulation can principally be applied in areas of the injection pipeline 101 and/or of the production pipeline 102 which extend outside the deposit 103.

The resistance heater can especially be operated with alternating current, preferably with alternating current of a frequency of between 50 and 60 Hz. The power source 506, when using alternating current with a frequency of between 50 and 60 Hz which essentially corresponds to the grid frequency, can be built by means of standard components.

According to various embodiments, a device 100, 800, especially a device as is shown in one of the FIGS. 5 to 10, can furthermore be operated in such a way that during a production phase, which with respect to time follows a heating-up phase, the injection pipeline is not only exposed to admission of superheated steam but the surroundings of the injection pipeline 101 are additionally heated by means of an induction heater. At least the active section 503 of the injection pipeline 101 can especially act as an induction heater. With the induction heater, the area of the deposit which surrounds the injection pipeline 101 can be heated.

Figure 11:
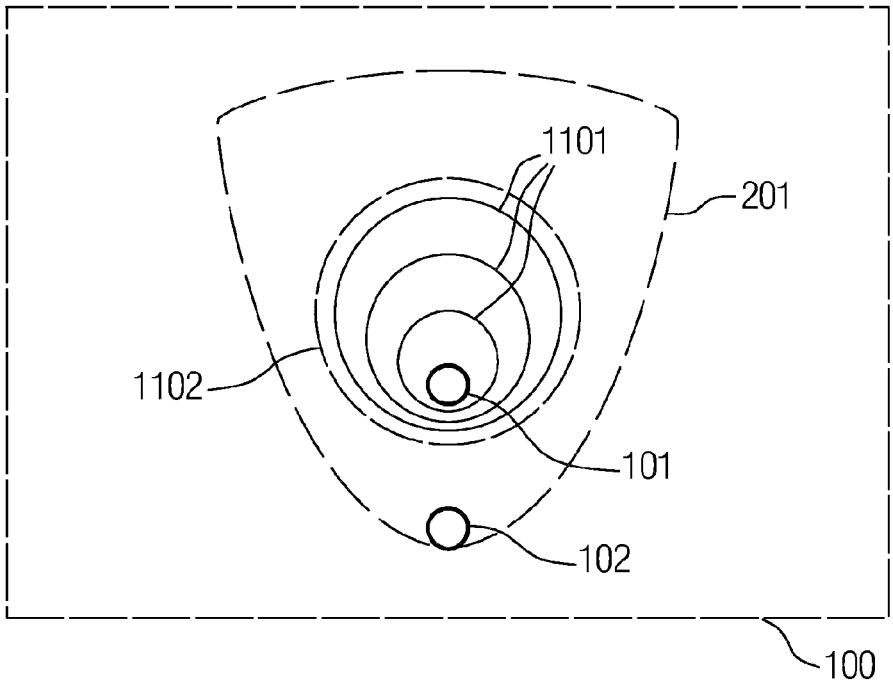
FIG. 11 shows heat loss distribution of an induction heater.

As already mentioned, FIG. 2 shows a cross section through an area 201 of a deposit 103 which is heated by means of superheated steam which issues from the injection pipeline 101. FIG. 11, as seen in cross section, shows the injection pipeline 101 and the production pipeline 102. FIG. 11 furthermore shows, in a schematic representation, a distribution 1101 of the heat loss inside the deposit 103 if the injection pipeline 101 or its active section 503 is operated as an induction heater. From extensive simulation calculations it emerges that the heat loss distribution 1101 makes a significant contribution in an area of the deposit 103 which lies essentially above (geodetically higher than) the injection pipeline 101. In comparison to the area which is represented in FIG. 2, which is preferably heated by superheated steam which issues from the injection pipeline 101, it is to be established that the heat loss distribution 1101 and the area 201 which is heated by the superheated steam noticeably overlap. The area 201 which is heated by superheated steam is also marked in FIG. 11.

In the area 1102, which is heated both by means of superheated steam and by means of the induction heater, the deposit 103 is heated more intensely than in the remaining areas. This heating leads to a higher production of hydrocarbonaceous substance, for example bitumen, from the stripping region in question. Furthermore, as a result of the quicker heating excessively high dissipation of heat in an area outside the intake section of the production pipeline 102 can be avoided.

According to a further exemplary embodiment, a method for the extraction of hydrocarbonaceous substance, for example bitumen, from a deposit 103 is disclosed, wherein the active sections 503, 504 of the injection pipeline 101 or production pipeline 102 are formed as a resistance heater, and during the heating-up phase the surroundings at least of the active sections of the injection pipeline 101 or production pipeline 102 are heated by means of the resistance heater.

Figure 12:
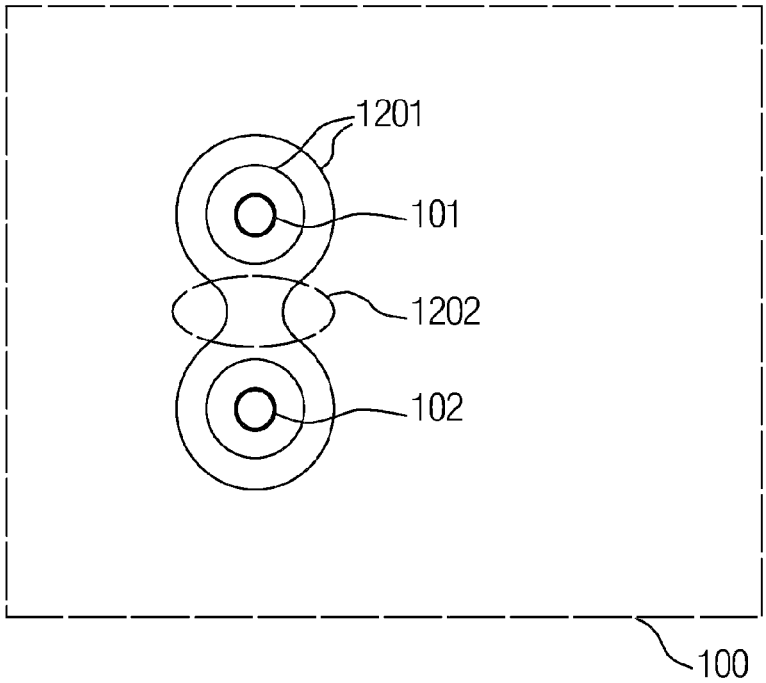
FIG. 12 shows a heat loss distribution of a resistance heater.

FIG. 12, as seen in cross section, shows the injection pipeline 101 and production pipeline 102 which lie inside a deposit 103. Furthermore, a heat loss distribution 1201 is shown for the case when the injection pipeline 101 and the production pipeline 102 are operated as a resistance heater. As is immediately apparent from FIG. 12, a significant contribution of the heat loss in an area of the deposit 103 which lies essentially between the injection pipeline 101 and the production pipeline 102 is to be seen. As a result, this area of the deposit during the heating-up phase is not only heated by means of superheated steam but additionally by means of the resistance heater. Since the area 1202 in question is heated particularly quickly, within a short space of time bitumen can already be extracted from this area 1202 via the production pipeline 102. This leads to an accelerated start of production.

Furthermore, as described in conjunction with FIG. 12, during the heating-up phase the deposit 103 can be additionally heated by means of the resistance heater in addition to with superheated steam. During the production phase, as described in conjunction with FIG. 11, the deposit 103 can additionally be heated by means of an induction heater.

The injection pipeline 101 can furthermore by exposed to admission of specially prepared superheated steam, especially during the heating-up phase. In the case of such a specific superheated steam, it can especially be the steam of a saline liquid. By such a steam being injected into the deposit 103, or into at least parts of the deposit 103, the electrical conductivity of the parts in question of the deposit 103, and therefore the electromagnetic induction, can be increased.

Figure 13:
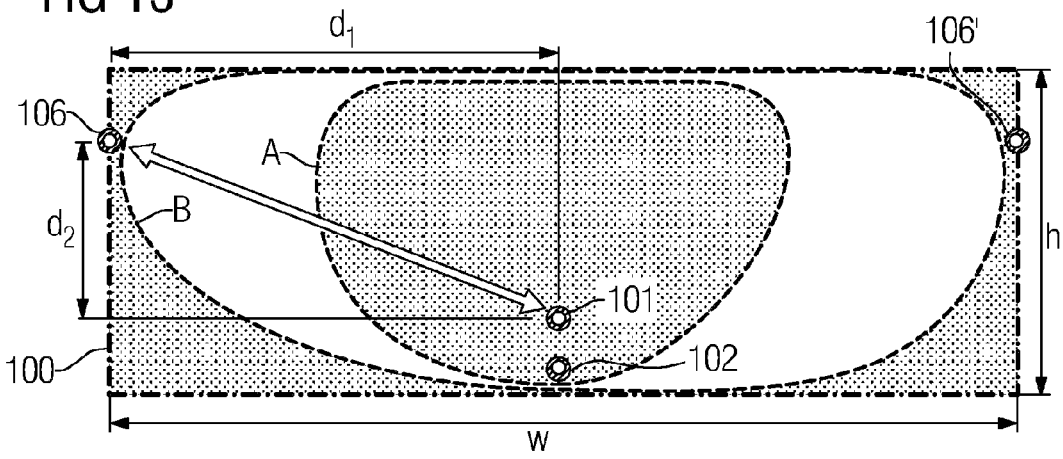
FIG. 13 shows a section perpendicular to the well pair consisting of injection pipe and extraction pipe from FIG. 1.

In FIG. 13, a horizontal pipe pair ("well pair") 101, 102 from FIG. 1 is shown in section, wherein the upper of the two pipes, i.e. the injection pipeline 101 from FIG. 1, in this case forms a first electrode. Furthermore, there is a further horizontal pipe 106 which is specially formed as a second electrode. The plane 100 which is perpendicular to the direction of the well pair indicates the heat distribution after a specific operating time of the installation with heated injection pipeline 101 and additional induction heater between the pipes 101 and 106 or 106' which act as electrodes.

In the adjacent sections to section 100, there are corresponding electrodes or pipes 106', 106", which are not shown in FIG. 13, so that a regularly repeating structure results.

In the arrangement which is shown, therefore, an inductive energizing with current is carried out by means of the electrical connections at the ends of the additional electrode 106 and of the injection pipe 101 so that a closed loop is created.

The horizontal distance from the electrode 106 to the extraction pipe is w/h; the vertical distance of the electrode 106, 106', . . . to the well pair, especially injection pipe 101, is for example 0.1 m to about 0.9 h. In this case, distances of between for example 0.1 m and 50 m result in practice. Corresponding repetition rates in a deposit with surface areas of several hundred meters result from this.

From FIG. 13, it can be gathered in detail that by means of the well pair with the pipes 101, 102 such an area is heated, the heat distribution of which at a defined time point is bordered approximately by the line A. As a result of the additional inductive heating between the pipes 101 and 106 corresponding heat distributions in the area which is bordered by the line B advantageously result in the boundary region. The area which is bordered by the line B can be asymmetric according to FIG. 3.

What is claimed is:

1. A method for the in-situ extraction of a hydrocarbonaceous substance, while reducing its viscosity, from an underground deposit with a device comprising:

at least one injection pipeline which projects into the deposit and at least one production pipeline which leads from the deposit, wherein the injection pipeline and the production pipeline have in each case a starting section which extends partially above ground and an active section which is connected to the starting section and extends inside the deposit, wherein at least the active section of the injection pipeline is additionally formed as an induction heater with respect to its surroundings in the deposit, and wherein the method comprises:

a heating-up phase, and a production phase following the heating-up phase, wherein during the heating-up phase, the injection pipeline and the production pipeline are exposed to admission of superheated steam, and wherein during the production phase, the injection pipeline but not the production pipeline is exposed to admission of superheated steam and the surroundings of the active section of the injection pipeline are additionally heated by means of the induction heater.

2. The method according to claim 1, wherein at least the active sections of the injection pipeline and of the production pipeline are part of a resistance heater, and during the heating-up phase the surroundings of the active sections of the injection pipeline and of the production pipeline are heated with the resistance heater.

3. The method according to claim 1, wherein during the production phase the injection pipeline is exposed to admission of special superheated steam which is converted to a liquid phase after delivery into the deposit, the liquid phase of the superheated steam having an increased electrical conductivity compared to water.

4. The method according to claim 3, wherein the liquid phase is a saline liquid.

5. A device for in-situ extraction of a hydrocarbonaceous substance, while reducing its viscosity, from an underground deposit, the device comprising:

at least one injection pipeline which projects into the deposit, and at least one production pipeline which leads from the deposit, wherein the injection pipeline and the production pipeline each include a starting section which extends partially above ground and an active section which is connected to the starting section and extends inside the deposit, wherein the device is configured for operation in which:

during a heating-up phase the injection pipeline and the production pipeline are exposed to admission of superheated steam, and during a production phase only the injection pipeline is exposed to admission of superheated steam, and wherein at least the active section of the injection pipeline is additionally formed as an induction heater with respect to its surroundings in the deposit.

6. The device according to claim 5, wherein the injection pipeline additionally has an end section which is connected to the active section and extends partially above ground, and a power source is electrically connected to the part of the starting section and end section of the injection pipeline which extends above ground.

7. The device according to claim 5, wherein the injection pipeline has an end section which is connected to the active section and extends inside the deposit, and the end section of the injection pipeline, with an electrical conductor which by means of an auxiliary bore is introduced into the vicinity of the end section of the injection pipeline, is electrically connected to a reservoir containing a saline liquid.

8. The device according to claim 5, wherein the active section of the injection pipeline forms an almost closed circle inside the deposit in the horizontal direction, and an end section which is located partially above ground is connected to the active section, wherein the parts of the starting section and of the end section of the injection pipeline which are located above ground are electrically connected to a power source.

9. The device according to claim 5, comprising multiple injection pipelines, each including an end section connected to the active sections and extending partially above ground, wherein at least the part of an end section of a first injection pipeline which is located above ground is electrically connected to the part of the starting section of a second injection pipeline which is located above ground.

10. The device according to claim 5, wherein the device is further configured for operation such that during the production phase the injection pipeline is exposed to admission of special superheated steam that is converted to a liquid phase after delivery into the deposit, the liquid phase of the superheated steam having an increased electrical conductivity compared to water.

11. The device according to claim 10, wherein the liquid phase is a saline liquid.

12. The device according to claim 5, wherein the induction heater is operated with a frequency of 10 kHz to 100 kHz.

13. The device according to claim 5, wherein at least the active sections of the injection pipeline and of the production pipeline are part of a resistance heater for heating a part of the deposit which lies essentially between the injection pipeline and the production pipeline.

14. The device according to claim 13, wherein the injection pipeline and the production pipeline are at least partially electrically insulated with respect to their surroundings.

15. The device according to claim 14, wherein the injection pipeline and the production pipeline are electrically insulated with respect to their surroundings at least in the areas which extend outside the deposit.

16. The device according to claim 13, wherein the resistance heater is operated with alternating current, preferably with alternating current of a frequency of 50 to 60 Hz.

17. The device according to claim 5, wherein the injection pipe forms a first electrode, and wherein the device includes one or more additional electrodes extending at least partially into the deposit.

18. The device according to claim 17, wherein the one or more additional electrodes include at least two horizontally guided electrodes.

19. The device according to claim 5, further including a horizontally guided electrode remote from the extraction pipe and the injection pipe, wherein the horizontally guided electrode and one of the extraction pipe and the injection pipe form a unit for energizing with current.

* * * * *